United States Patent [19]

Ida

[11] 4,346,371

[45] Aug. 24, 1982

[54] ALARM CIRCUIT

[75] Inventor: Edward S. Ida, Newark, Del.

[73] Assignee: E. I. Du Pont de Nemours and Company, Wilmington, Del.

[21] Appl. No.: 189,627

[22] Filed: Sep. 22, 1980

[51] Int. Cl.[3] ..... G08B 29/00

[52] U.S. Cl. ..... 340/507; 340/635; 340/679; 361/23; 417/63

[58] Field of Search ..... 340/507, 506, 509–511, 340/526, 635, 649, 650, 657, 679, 660–664; 361/23, 28, 78, 83, 86–94, 173, 174, 187, 198, 203, 205, 60; 307/130, 131; 417/63

[56] References Cited

U.S. PATENT DOCUMENTS

| | | | |
|---|---|---|---|
| 3,509,359 | 4/1970 | Embling | 340/507 |
| 3,588,857 | 6/1971 | Gessner | 340/507 |
| 3,831,161 | 8/1974 | Enabnit | 340/507 |
| 3,854,089 | 12/1974 | Emler | 340/663 |
| 4,059,845 | 11/1977 | Kolkman | 361/198 |

OTHER PUBLICATIONS

"Design of Fail-Safe Control Systems", J. A. Bryant Power (pp. 52–56) Jan. 1976.

*Primary Examiner*—John W. Caldwell, Sr.
*Assistant Examiner*—Donnie L. Crosland

[57] ABSTRACT

An alarm switch circuit includes an opto-isolator that is used as a high speed switch to control the pulse generation rate of an oscillator circuit which in turn maintains a set of normally open contacts of an interlock relay in the closed condition. The fail-safe design features are not negated should the following conditions occur: (1) a loss of power, (2) one or more independent failures of circuit elements, (3) open or short circuit failures of the set point (SP) or process variable (PV) voltages or their polarity reversals and (4) the background noise masks the PV signal.

3 Claims, 2 Drawing Figures

ALARM CIRCUIT

BACKGROUND OF THE INVENTION

This invention relates to an alarm circuit for indicating the presence of abnormal conditions and more particularly to an electronic alarm switch incorporating fail-safe concepts.

Power plant control systems manufacturers and the transportation industry are constantly on the lookout for fail-safe alarm circuits that will guarantee an interlock shutdown when the sensed analog control signal has either disappeared or weakened so that timely action can be taken to place back-up systems on-line or to activate other safeguards to meet the indicated contingency.

Several methods are known in the art to provide fail-safe monitoring of process variable signals. U.S. Pat. No. 3,588,857 discloses means for level detecting a difference signal obtained by differencing two redundant but separate input signals and applying the result to control an oscillator type alarm circuit.

U.S. Pat. No. 3,854,089 discloses a way to employ an LED annunciator to monitor the currents of one or more current sources and an opto-isolator to isolate the voltages being monitored from affecting the operating-voltage of the fail-safe circuitry.

However, most fail-safe circuitry in the art is relatively complex with the use of many active elements, in contrast to this invention which uses only three. Furthermore, this invention details a unique way to combine the virtues of electrically isolating the monitoring circuit from the process variable (PV) signal by means of an opto-isolator element which simultaneously provides direct control over the oscillator controlled alarm.

SUMMARY OF THE INVENTION

A fail-safe low- or high-voltage signal monitoring circuit that includes a load circuit activated by a pulsating signal, an opto-isolator receiving said monitored signal at the input terminal of the switching element of said opto-isolator; a comparator having a first input terminal connected to a setpoint voltage source and its second input terminal connected to the other terminal of said opto-isolator switching element, wherein the bias currents of said comparator flow out of both terminals to circuit common via the setpoint voltage source and a dropping resistor, respectively; and a signal delay circuit connecting the output terminal of said comparator with a Schmitt trigger circuit having its output terminal joining the input terminals of said load circuit to the active terminal of said opto-isolator.

The fail-safe design features of the alarm switch provide that it will deactivate the load, typically an interlock relay provided with normally open (NO) contacts, should the following conditions occur: (1) loss of power, (2) one or more independent failures of circuit elements, (3) open circuit or short circuit failures of either set point (SP) or PV voltages or their polarity reversals and (4) the PV signal remains buried in background noise.

DETAILED DESCRIPTION OF THE PREFERRED EMBODIMENT

Figure 1:
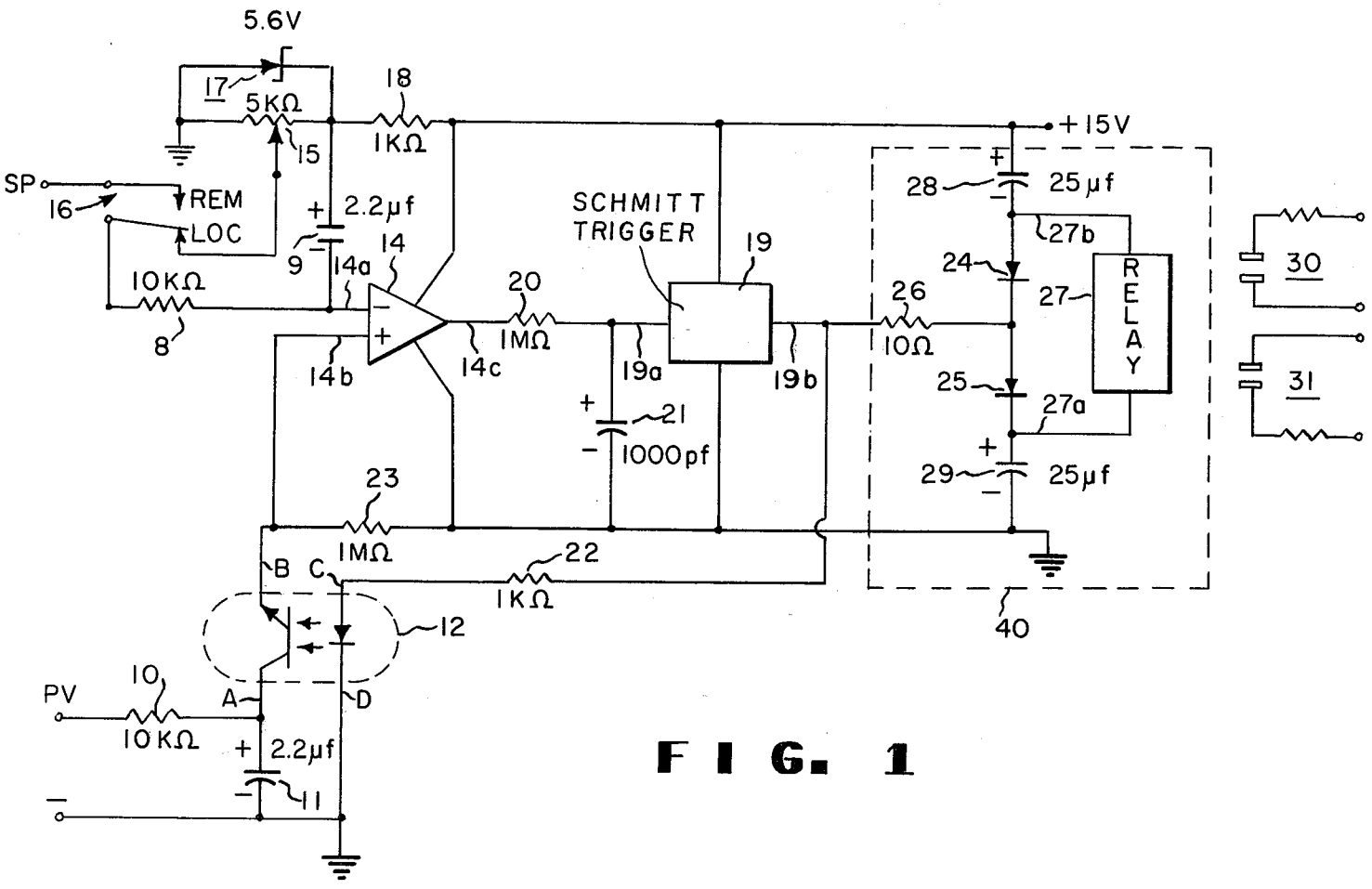
FIG. 1 is a schematic circuit of the fail-safe electronic alarm switch of this invention.

A time varying DC process variable (PV) signal is applied to a low-pass filter comprising a 10 Kohm resistor 10 and a 2.2 μf electrolytic capacitor 11 before it is input to the collector, terminal A, of opto-isolator 12. This filter is used to reduce the noise content of the PV input signal.

Opto-isolator 12, typically a Monsanto Company MCT 6, serves as a high-speed switch to control the oscillation or pulse generation rate of the oscillator that comprises an RC network including resistor 20, and capacitor 21, op amp 14 and Schmitt trigger circuit 19. An opto-isolator was selected for use in this invention since it is the only control element available on the market that is essentially completely fail-safe. This device provides that stray voltages picked up in the alarm circuitry do not have a leakage path back into the input circuit in an unsafe direction. Furthermore, when any element within opto-isolator 12 fails (open, short, or partially so), switching action, and thus circuit oscillations, cease. This in turn causes an alarm to be sounded and terminates the controlled fail-safe "energy pump" type circuit operation.

The low-or-no signal monitoring configuration is preferred over the high signal alarm configuration since it is more fail-safe with regard to the received PV signal. This is because the PV signal can be either short circuited or open circuited due to transmission wiring faults. Consequently a low signal monitor will naturally detect that condition. Loss of power to the PV transmitter will also cause a low PV signal output.

In the low-or-no signal monitoring configuration, the emitter, terminal B, of opto-isolator 12 is connected directly to the noninverting terminal **14*b* of comparator 14, comprising typically a National Semi-Conductor Company LM224D op amp. The setpoint (SP) voltage input, selected by remote-local switch 16, is connected to the inverting terminal 14*a* through a filter network comprising 10 Kohm resistor 8 and 2.2 μf capacitor 9** which is used to limit the noise riding on the applied remote setpoint signal input.

The function of setpoint switch 16 is to provide a reference voltage above which the input PV signal must rise in order to change the comparator's output state. Zener diode 17 is connected across potentiometer 15 to insure that the inverting terminal of comparator 14 is biased at 5.6 volts. A 1 Kohm resistor 18 connects the ungrounded terminal of potentiometer 15 to the (+) 15 volt supply (preferably regulated) whose function is to limit current through Zener diode 17. The tap of potentiometer 15 is used to select the local SP voltage desired.

The output terminal **14*c* of comparator 14 is connected to a Schmitt trigger circuit 19, formed from a type 555 timer, via a low pass filter circuit comprising 1 M ohm resistor 20 and 1000 pf capacitor 21. This filter arrangement is used to generate a ramp signal from the logic high output signals produced by comparator 14 as capacitor 21 charges or discharges. The ramp signal voltage in turn is used to change the state of the Schmitt trigger 19 output signal in a direction opposite to that exhibited by the polarity of the interrogating ramp signal. The type 555 timer is arranged such that its input pins 2 and 6 are tied together; pin 3 is the output terminal; (+) power is connected to pin 8 and (−) power is connected to pin 1; and reset is disabled by jumpering pins 4 and 5**.

In addition to load circuit 40, the output terminal 19*b* of Schmitt trigger 19 is connected to the photodiode terminal C of opto-isolator 12 via 1 K ohm current limiting resistor 22. The D terminal of opto-isolator 12 is connected to circuit common and a 1 M ohm resistor 23 connects the junction of terminal B of opto-isolator 12 and the noninverting terminal 14*b* of comparator 14 with circuit common.

The output of Schmitt trigger 19 passes directly to the load circuit 40 via the 10 ohm current limiting resistor 26. A typical load circuit may be the "energy pump" comprising serially connected diodes 24, 25 for energizing relay 27. In this circuit, the cathode terminal of diode 24 is connected to the (−) terminal of 25 μf capacitor 28 having its (+) terminal connected to the (+) 15 volt supply whereas the anode terminal of diode 25 is connected to the (+) terminal of capacitor 29 which has its (−) terminal connected to circuit common. Relay 27 connects the cathode of diode 24 with the anode of diode 25 through lines 27*b* and 27*a*, respectively, and, provided an oscillating signal is present at the output of Schmitt trigger 19, functions to maintain closed in a fail-safe manner the sets of normally open (NO) contacts 30, 31.

The high alarm circuit configuration is identical to that shown in FIG. 1 with the exception that the SP and PV signal inputs are reversed, i.e., the SP signal from switch 16 is input to resistor 10 and the PV signal is input to resistor 8.

In operation, the alarm switch of this invention is most easily explained by way of examples: (a) normal PV voltage levels, (b) low PV voltage levels, (c) open circuit input (signal loss), (d) short circuit input (signal loss), (e) open and short circuited set point voltage levels, (f) reduction or loss of power, and finally (g) an alarm circuit component failure or drift in circuit component value.

(a) For the normally operating low voltage signal monitoring configuration, the PV signal at the input terminal of comparator 14 must be at least equal to the set point limit derived from set point switch 16 whereas for the high voltage configuration the PV signal must be no greater than the SP voltage. With this condition satisfied, a high logic level signal at the output of comparator 14 is applied to Schmitt trigger 19 via low pass filter circuit 20, 21. As capacitor 21 charges up, Schmitt trigger 19 fires when the voltage reaches a value of about $\frac{2}{3}$ that of applied signal and causes the previously high level Schmitt trigger output signal to go low. This turns off the LED in opto-isolator 12 which effectively opens the switch to the PV signal appearing across capacitor 11. With no conduction of current through opto-isolator 12, the potential at the noninverting terminal of op amp 14 falls, as it is pulled down by resistor 23. As the capacitor 21 voltage falls to $\frac{1}{3}$ the level of the previously applied signal, the Schmitt trigger 19 resumes generation of a high level signal to turn on the LED in opto-isolator 12. This effectively closes the opto-isolator switch to allow the PV signal to reappear at the noninverting terminal of op amp 14, which again generates a logic high signal at its output. Thus for normal operating conditions, this circuit serves to produce an oscillating square-wave signal with a pulse rate sufficiently high to maintain the set of normally open (NO) relay contacts in the closed position.

(b) In the low voltage alarm case where the PV signal level falls below the value established by set point circuit 16 at the terminals of comparator 14, or rises above SP for the high alarm situation, the voltage appearing at the output of comparator 14 drops to zero and remains there as long as the PV input signal remains low or high as the case may be. Consequently, the output of the Schmitt trigger 19 remains at a high level to thereby maintain a continuous current flow through the LED of opto-isolator circuit 12. Since opto-isolator 12 no longer toggles on-off, oscillation does not occur and an out-of-tolerance PV signal is indicated. Recall that either a steady high or a steady low output signal from Schmitt trigger 19 causes the "energy pump" circuit to open up relay 27.

(c) For the open circuit PV case, the alarm circuit will continue to oscillate until the charge on input filter capacitor 11 dissipates to ground through resistor 23 during each conduction period of opto-isolator 12. Upon PV voltage reaching a level lower than or higher than that established by set point circuit 16, as the particular situation dictates the alarm circuit ceases oscillation and opens relay 27, as explained in detail in case (b) above.

(d) A shorted PV input signal discharges capacitor 11 and causes immediate cessation of oscillation by the mechanism described in cases (b) and (c) above.

(e) In the low alarm configuration an open circuit in the selected (rem/local) set point circuit allows the bias current of op amp 14 to establish a voltage at its inverting terminal which is above the original set point level. This in turn causes a low-voltage cessation of oscillation as described in (b) above. On the other hand, a short circuit condition is also safe provided the potential at the inverting terminal of op amp 14 is made to be below that appearing across resistor 23 during the nonconducting periods of opto-isolator 12, when the bias current from the noninverting terminal of op amp 14 flows through the resistor 23. The low voltage requirement is obtained by specifying the resistance of resistor 23 such that it provides a $\frac{1}{4}$ to 1 volt drop. These circuit element failures have a similar effect on the operation of the high voltage alarm configuration as well.

(f) For reduction or loss of power the charge pump operation of load circuit 40 ceases and the relay contacts open immediately.

(g) Oscillation of the alarm circuit will either cease or be modified to the point where the fail-safe load cannot be sustained upon failure (open, short or value change) of any element comprising it. In the local set point mode, the most critical element of the alarm circuit is the Zener diode 17. If such an element is used, and its reverse voltage rating drifts toward a lower value, such a condition could easily mask a reduced voltage PV signal which otherwise should have caused a shutdown. However, an aged high stability Zener diode or an integrated circuit (IC) regulator (e.g., Motorola Corporation MC1404-5) can be used just as well.

For the high alarm configuration, wherein a drift toward a higher value is unsafe, the use of two matched Zener diodes in parallel for redundancy is good protection from such an event.

Figure 2:
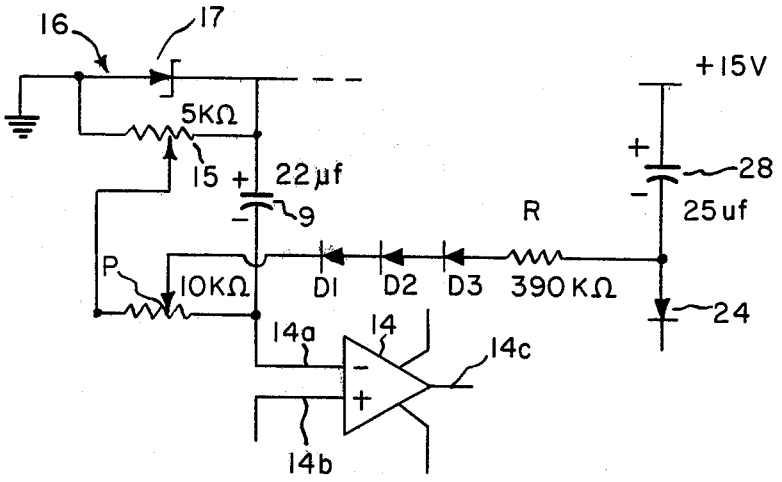
FIG. 2 is a schematic of an adjustable dead band circuit shown connected to the circuit of FIG. 1.

FIG. 2 is a schematic diagram of an alarm adjustable dead band circuit which may be used in both high and low alarm cases where it is necessary to guard against multiple-triggering on noisy or fluctuating input signals. Such signals are commonly found in annunciator circuits. Using the circuit of FIG. 2 an alarm condition will not be reset unless the monitored PV signal rises to a value 0.5%–5% higher than the SP voltage.

Failsafety is preserved by means of triple redundancy provided by blocking diodes D1, D2, and D3, which may be a triple junction diode such as a General Electric Company 1N4157, whereas the degree of dead band required is specified by the setting of 10 Kohm potentiometer P, which replaces resistor 8 of FIG. 1.

In operation, use is made of the voltage rise on the (−) side of capacitor 28 when an alarm conditon is sensed. This voltage rises from about +2 volts to about +14 volts (for the 15 volts supply, shown) and thus provides a current flow into potentiometer P to raise further the set point voltage applied to the inverting terminal of comparator 14. Since the voltage on capacitor 28 must be low to hold the relay in, if it fails to rise, the dead band effect is lost but not in an unsafe direction as oscillation will soon cease as well as the energy pump.

What is claimed is:

1. A fail-safe circuit for monitoring a signal that includes a load circuit having input terminals and a pulsating signal source for actuation thereof, said pulsating signal source comprising: an opto-isolator having emitter, collector and active photodiode terminals, the monitored signal being fed to said collector terminal, said collector terminal and said emitter terminal being operatively connected; a comparator having an inverting terminal, a noninverting terminal and an output terminal; a set point voltage source connected to the inverting terminal of the comparator; the noninverting terminal being connected to said emitter terminal of said opto-isolator; an oscillating Schmitt trigger circuit having input and output terminals; a signal delay circuit connecting the output terminal of the comparator with input terminal of the Schmitt trigger circuit, the output terminal of the Schmitt trigger circuit joining the input terminals of the load circuit to the active photodiode terminal of the opto-isolator whereby a failure mode will cause said Schmitt trigger to cease oscillating as a pulsating signal source, deactivating said load circuit.

2. The fail-safe circuit of claim 1, wherein the monitored signal is input to the inverting terminal of said comparator and said set point voltage signal is connected to the collector terminal of said opto-isolator.

3. The fail-safe circuit of claim 1 or 2, wherein the load circuit is a normally energized relay coil activated by an energy pump circuit.

* * * * *